United States Patent [19]

D'Amato et al.

[11] Patent Number: 4,631,439

[45] Date of Patent: Dec. 23, 1986

[54] CATHODE-RAY TUBE HAVING CYLINDRICAL FACEPLATE AND SHADOW MASK WITH MINOR AXIS CURVATURES

[75] Inventors: Ralph J. D'Amato; Richard H. Godfrey, both of Lancaster, Pa.

[73] Assignee: RCA Corporation, Princeton, N.J.

[21] Appl. No.: 469,701

[22] Filed: Feb. 25, 1983

[51] Int. Cl.[4] ..... H01J 29/07

[52] U.S. Cl. ..... 313/402; 313/408; 313/477 R

[58] Field of Search ..... 313/402, 403, 404, 405, 313/406, 407, 408, 477 R; 220/2.1 A, 2.3 A; 358/250

[56] References Cited

U.S. PATENT DOCUMENTS

| | | | |
|---|---|---|---|
| 2,307,210 | 1/1943 | Goldsmith | 358/250 |
| 2,806,162 | 9/1957 | McQuillen et al. | 313/402 |
| 3,931,906 | 1/1976 | Bradu | 220/2.1 A |

FOREIGN PATENT DOCUMENTS

| | | | |
|---|---|---|---|
| 53-83572 | 7/1978 | Japan | 313/402 |
| 54-3464 | 1/1979 | Japan | 313/403 |
| 55-28269 | 2/1980 | Japan | 313/477 R |
| 1358161 | 6/1974 | United Kingdom | 313/477 |

*Primary Examiner*—Palmer C. DeMeo
*Assistant Examiner*—K. Wieder
*Attorney, Agent, or Firm*—Eugene M. Whitacre; Dennis H. Irlbeck

[57] ABSTRACT

A shadow mask type cathode-ray tube includes a rectangular faceplate having curvature along its minor axis but no curvature along its major axis. The shadow mask of the tube also has curvature along its minor axis and no curvature along its major axis. The mask is of a type of steel having a linear coefficient of thermal expansion of less than $3\times10^{-6}$ $\Delta l/l/°C$.

4 Claims, 2 Drawing Figures

CATHODE-RAY TUBE HAVING CYLINDRICAL FACEPLATE AND SHADOW MASK WITH MINOR AXIS CURVATURES

This invention relates to shadow mask type cathode-ray tubes (CRT's) and particularly, to the contours of the faceplate panels and shadow masks of such tubes.

BACKGROUND OF THE INVENTION

There are two basic faceplate panel and shadow mask contours utilized for shadow mask type CRT's. These basic contours are spherical and vertically cylindrical. In tubes having a spherical contour, the faceplates have the same curvatures along both their major and minor axes. The shadow masks in these tubes may vary somewhat from being truly spherical but still may be considered to be substantially spherical. In a tube having a vertically cylindrical contour, both the faceplate and the shadow mask have curvatures along their major axis but are straight along their minor axis.

Although the spherical contour and the cylinder with major axis curvature contour are adequate for most viewing situations, there still is a need for other faceplate contours to meet the needs of other viewing situations.

SUMMARY OF THE INVENTION

A shadow mask type cathode-ray tube includes a rectangular faceplate having curvature along its minor axis but no curvature along its major axis. The shadow mask of the tube also has curvature along its minor axis and no curvature along its major axis. The mask is of a type of steel having a linear coefficient of thermal expansion of less than $3\times10^{-6}\ \Delta l/l/°C$.

DETAILED DESCRIPTION OF THE PREFERRED EMBODIMENT

Figure 1:
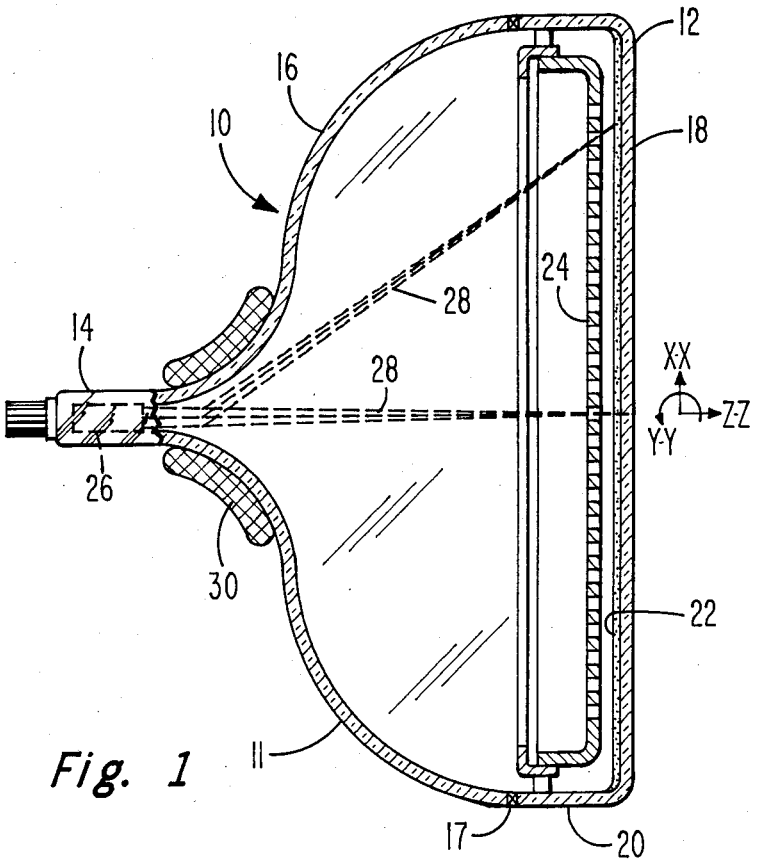
FIG. 1 is a plan view, partially in axial section, of a shadow mask type cathode-ray tube in which one embodiment of the present invention is incorporated.
Figure 2:
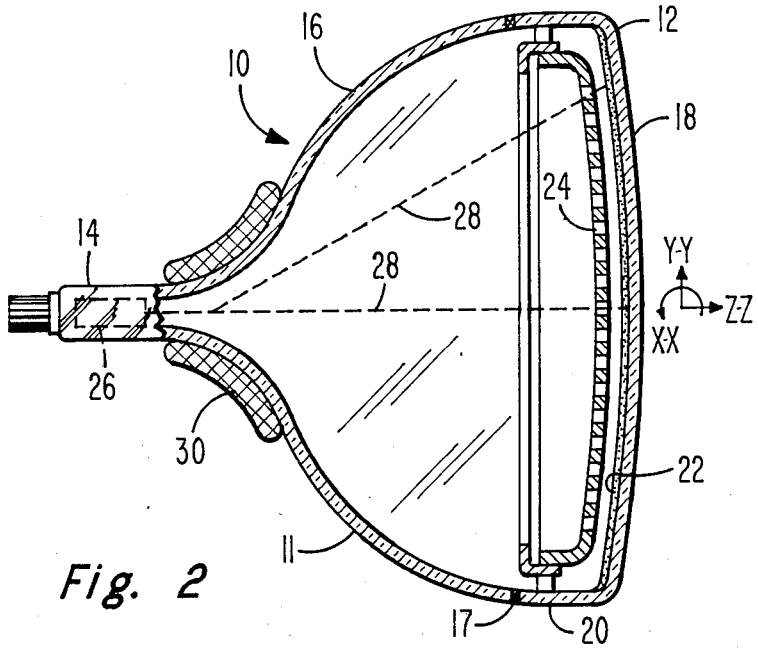
FIG. 2 is an elevational view, partially in axial section, of the tube of FIG. 1.

FIGS. 1 and 2 show a rectangular color picture tube 10 type of cathode-ray tube (CRT) having a glass envelope 11 comprising a rectangular faceplate panel 12 and a tubular neck 14 connected by a funnel 16. The panel comprises a viewing faceplate 18 and a peripheral flange or sidewall 20 which is sealed to the funnel 16 by a glass frit 17. A three-color phosphor screen 22 is carried by the inner surface of the faceplate 18. The screen is preferably a line screen with the phosphor lines extending substantially parallel to the minor axis Y—Y of the tube (normal to the plane of FIG. 1 and vertical in FIG. 2). Alternately, the screen also can be a dot screen. A multi-apertured color selection electrode or shadow mask 24 is removably mounted within the faceplate panel 12 in predetermined spaced relation to the screen 22. An inline electron gun 26, shown schematically by dashed lines, is centrally mounted within the neck 14 to generate and direct three electron beams 28 along coplanar convergent paths through the mask 24 to the screen 22. Alternately, the electron gun also can have a triangular or delta configuration.

The tube 10 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally in the direction of the major axis (X—X) and in the direction of the minor axis (Y—Y), respectively, in a rectangular raster over the screen 22.

The faceplate 18 has a horizontally cylindrical contour with curvature along its minor axis (Y—Y) and substantially no curvature (substantially straight) along its major axis (X—X). In its viewing orientation, the minor axis of the faceplate is vertical, and the major axis is horizontal.

The shadow mask 24 also has a horizontally cylindrical contour with curvature along its minor axis and substantially no curvature along its major axis. Apertures in the shadow mask 24, for the preferred line screen embodiment, are elongated slits arranged in columns that parallel the minor axis of the mask. The slits within a column are separated from each other by bridges or webs. The presence of these webs adds structural integrity to the mask by tying various portions of the mask together.

In a preferred embodiment, the shadow mask is fabricated from a type of steel having a coefficient of thermal expansion of less than $3\times10^{-6}\ \Delta l/l/°C$. (increase in length per unit length per degree Centigrade), such as Invar (trademark of International Nickel Co.), which has a coefficient of thermal expansion of about $0.9\times10^{-6}\ \Delta l/l/°C$.

GENERAL CONSIDERATIONS

An increase in cathode-ray tube size results in an increase in the sagittal height and glass thickness of the faceplate in order to withstand atmospheric pressure. Sagittal height is the height difference between the center and periphery of a faceplate measured in the direction of the longitudinal (Z) axis of a tube. Since much of the structural strength of a faceplate is derived from the sectional curvature parallel to the minor axis of the faceplate, the increase in faceplate sagittal height that results from curvature on the major axis or the diagonals contributes little to the strength of the tube. A spherical faceplate with a standard 3:4 aspect ratio screen has minor, major and diagonal sagittal heights in the ratio of 0.36:0.64:1, respectively. A horizontally cylindrical faceplate with a sagittal height approximately 40% of a spherical faceplate provides comparable strength. For large tubes of about 670 mm diagonal, this results in a 30 to 50 mm reduction in tube length. In addition to this length advantage, the horizontally cylindrical faceplate also provides a viewing improvement. In many applications, such as in data terminals or in table model television receivers, the vertical viewing angle required is small since the viewer's eyes are generally level with the center of the tube. Therefore, faceplate curvature in the vertical direction is not restrictive. However, since a viewer may be seated at wide horizontal angles relative to a tube, a horizontally cylindrical faceplate, which is straight parallel to its major axis, provides excellent viewability at these wide angles.

If a horizontally cylindrical shadow mask, such as disclosed herein, were made of low carbon steel, as in the practice with conventional designs, the thermal rise that results from electron beam bombardment would cause mask expansion resulting in misregister of the electron beams with their associated phosphor screen elements. Such misregister would be of the order of 0.15 mm, which is about three times greater than that attained with a spherical mask. This problem is overcome in the present invention by making the mask of a low expansion material, such as Invar, while simultaneously resolving several problems associated with the use of such materials. For example, although the use of Invar has been suggested in the art for spherical masks, it is relatively expensive and has formability problems. The formability problems include excessive spring-back and tearing when formed. Since forming a horizontally cylindrical mask, as disclosed herein, only requires bending the material not stretching it, there are none of the spring-back or tearing problems associated with the spherical shaping of Invar.

The resolution of spring-back and tearing problems by utilizing a horizontally cylindrical mask shape also permits a thinner mask material to be used. For example, an Invar mask can be less than 0.1 mm thick, thereby resulting in considerable cost savings. Use of a thinner mask material also permits the etching of smaller, closer spaced apertures, thereby resulting in higher screen resolution. Furthermore, since a horizontally cylindrical mask is bent, not stretched, smaller and fewer webs are required in the aperture columns to maintain the structural integrity of the mask. This increases both the electron beam transmission of the mask and the resultant light output of the tube.

Although in the preferred embodiment incorporating the present invention, a horizontally cylindrical shadow mask is constructed of Invar, it is anticipated that it may be desirable to construct masks of materials having somewhat higher coefficients of thermal expansion. The primary purpose of using these materials having higher coefficients would be to obtain a closer match between expansion of the mask and the faceplate panel. As an example, in operation of one prior art tube, a low carbon steel shadow mask was heated 35° C. above ambient, and the faceplate was heated 5° C. above ambient. The faceplate glass in this tube had a coefficient of thermal expansion of about $9.7\times10^{-6}\,\Delta l/l/°C$. The low carbon steel shadow mask had a coefficient of thermal expansion of about $13\times10^{-6}\,\Delta l/l/°C$. Therefore, in this prior art tube, the expansion of the mask is far greater than the expansion of the faceplate, thereby requiring movement of the shadow mask toward the faceplate to maintain registry between the shadow mask apertures and the screen elements. However, in a tube utilizing the same faceplate glass but having an Invar mask with a coefficient of thermal expansion of about $0.9\times10^{-6}\,\Delta l/l/°C$., wherein the faceplate and mask are heated the same amounts, the Invar mask will expand less than does the faceplate. Therefore, a correction is needed which will move the mask away from the faceplate during tube operation. Given these two examples, it can be seen that it may be desirable to select a mask material that would minimize this need for mask position correction. For most contemplated faceplate materials, the shadow mask material selected should have a coefficient of thermal expansion somewhat less than about $3\times10^{-6}\,\Delta l/l/°C$. if the full advantages of the invention are to be appreciated.

What is claimed is:

1. A shadow mask type cathode-ray tube including, a cylindrical faceplate having a rectangular peripheral shape with two long sides and two short sides and having curvature along its minor axis which substantially parallels the two short sides and being substantially straight along its major axis which substantially parallels the two long sides;

an apertured shadow mask mounted within said tube, said mask having curvature along its minor axis and being substantially straight along its major axis, said mask being of a type of metal having a linear coefficient of thermal expansion of less than $3\times10^{-6}\,\Delta l/l/°C$.; and said faceplate having a sufficiently larger linear coefficient of thermal expansion than that of said shadow mask to require correction for moving the shadow mask away from said faceplate during tube operation.

2. A shadow mask type cathode-ray tube including, a cylindrical faceplate having a rectangular peripheral shape with two long sides and two short sides and having curvature along its minor axis which substantially centrally parallels the two short sides and being substantially straight along its major axis which substantially centrally parallels the two long sides, an apertured shadow mask mounted within said tube, said mask having curvature along its minor axis and being substantially straight along its major axis, said mask having a plurality of slit-shaped apertures therein the lengthwise dimension of said slit apertures being parallel to the minor axis of said mask, and said apertures being aligned in columns parallel to the minor axis of said mask, and said faceplate having a substantially larger linear coefficient of thermal expansion than that of said shadow mask.

3. The tube as defined in claim 2, wherein the linear coefficient of thermal expansion of said mask being less than about $3\times10^{-6}\,\Delta l/l/°C$.

4. The tube as defined in claims 1 or 3, wherein said mask is constructed of an alloy comprising about 63.8 percent iron, about 36 percent nickel and about 0.2 percent carbon.

* * * * *